US010622760B2

(12) United States Patent
Tsukiyoshi

(10) Patent No.: US 10,622,760 B2
(45) Date of Patent: Apr. 14, 2020

(54) LEVER-TYPE CONNECTOR

(71) Applicant: Sumitomo Wiring Systems, Ltd., Yokkaichi, Mie (JP)

(72) Inventor: Keiichi Tsukiyoshi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/253,594

(22) Filed: Jan. 22, 2019

(65) Prior Publication Data

US 2019/0229466 A1 Jul. 25, 2019

(30) Foreign Application Priority Data

Jan. 25, 2018 (JP) ..... 2018-010239

(51) Int. Cl.
*H01R 13/42* (2006.01)
*H01R 13/629* (2006.01)

(52) U.S. Cl.
CPC ... *H01R 13/62938* (2013.01); *H01R 13/6295* (2013.01); *H01R 13/62955* (2013.01)

(58) Field of Classification Search
CPC ..... H01R 13/62938; H01R 13/6295; H01R 13/62955
See application file for complete search history.

(56) References Cited

U.S. PATENT DOCUMENTS 5,876,225 A * 3/1999 Katsuma ..... H01R 13/62938 439/157
2006/0089030 A1* 4/2006 Fukatsu ..... H01R 13/62938 439/157
2010/0105254 A1* 4/2010 Park ..... H01R 13/40 439/752
2010/0184319 A1* 7/2010 Kameda ..... H01R 12/79 439/329
2011/0070763 A1* 3/2011 Kobayashi ..... H01R 13/6295 439/345
2012/0129381 A1* 5/2012 Makino ..... H01R 13/62938 439/372
2013/0102172 A1 4/2013 Kobayashi et al.
2014/0065849 A1* 3/2014 Kida ..... H01R 12/7023 439/65
2014/0113476 A1* 4/2014 Shimizu ..... H01R 13/62933 439/310

(Continued)

FOREIGN PATENT DOCUMENTS

JP 2012-18877 1/2012

*Primary Examiner* — Truc T Nguyen
(74) *Attorney, Agent, or Firm* — Gerald E. Hespos; Michael J. Porco; Matthew T. Hespos

(57) ABSTRACT

A lever-type connector (F) includes a housing (10) formed with support shafts (26) and rotation restricting portions (20F, 20R). A lever (30) includes plate-like arms (31) and is rotatable between an initial position where the lever waits at the start of connection to a mating connector (M) and a connection position where the connection to the mating connector (M) is completed. The lever (30) is mounted by fitting bearing holes (34) of the arms (31) to the support shafts (26). Reverse rotation restricting projections (45) project from surfaces of the arms (31) facing the housing (10) toward the housing (10) and are configured to be locked to the rotation restricting portions (20F, 20R) to restrict rotation of the lever (30) at the initial position toward a side opposite to the connection position.

5 Claims, 15 Drawing Sheets

(56) References Cited

U.S. PATENT DOCUMENTS

| | | | | |
|---|---|---|---|---|
| 2014/0148025 | A1* | 5/2014 | Shimizu | H01R 13/62933<br>439/159 |
| 2016/0164210 | A1* | 6/2016 | Choi | H01R 13/62933<br>439/660 |
| 2016/0352039 | A1* | 12/2016 | Yamaki | H01R 13/506 |

* cited by examiner

LEVER-TYPE CONNECTOR

BACKGROUND

Field of the Invention

The invention relates to a lever-type connector.

Related Art

Japanese Unexamined Patent Publication No. 2012-018877 discloses a lever-type connector with a lever formed by coupling two parallel arms to each other by an operating portion. Each arm is formed with a bearing hole to be fit to a support shaft projecting from an outer side surface of a housing, and the lever is rotatable about the support shafts and the bearing holes between an initial position and a connection position. In connecting this connector to a mating connector, the lever is held at the initial position and cam pins of the mating connector are inserted into the entrances of cam grooves of the lever by lightly fitting the connectors. The connectors are connected by rotating the lever toward the connection position. The lever includes extending portions extending radially out from outer peripheral edges of the arms, and the operating portion is formed on extending end parts of the extending portions. With the lever located at the initial position, the extending portions are locked to rotation restricting portions of the housing, thereby restricting rotation of the lever toward a side opposite to the connection position.

In the above lever-type connector, it is considered to lock the rotation restricting portions to the arms rather than to the extending portions due to design restrictions of the housing. In this case, projections project radially out from the outer peripheral edges of the arms and lock to the rotation restricting portions. However, if the projections project from the outer peripheral edges of the arms, the problem is that the arms are enlarged.

The invention was completed on the basis of the above situation and aims to avoid the enlargement of an arm.

SUMMARY

The invention is directed to a lever-type connector with a housing formed with a support shaft and a rotation restricting portion. A lever including a plate-like arm with a bearing hole that is fit to the support shaft. The lever is rotatable between an initial position where the lever waits at the start of connection to a mating connector and a connection position where the connection to the mating connector is completed. A reverse rotation restricting projection projects from a surface of the arm facing the housing toward the housing, the reverse rotation restricting projection is configured to restrict rotation of the lever at the initial position toward a side opposite to the connection position by being locked to the rotation restricting portion.

The reverse rotation restricting projection projects toward the housing from the surface of the arm facing the housing. Thus, an outer diameter of the arm can be made smaller as compared to the case where a reverse rotation restricting projection projecting radially outward from an outer peripheral edge of the arm is formed.

The arm in one embodiment is formed with a guide groove configured to guide the support shaft to the bearing hole in the process of assembling the lever with the housing. The reverse rotation restricting projection is disposed in an area corresponding to the guide groove on a surface of the arm on a side opposite to the guide groove. An area of the arm where the guide groove is formed is thin and easily resiliently deformed. Thus, resistance when the reverse rotation restricting projection moves over the rotation restricting portion in the process of assembling the lever with the housing is low.

The guide groove in one embodiment is formed with two slits disposed to sandwich a formation area of the reverse rotation restricting projection. The slits make an area of the guide groove where the reverse rotation restricting projection is formed easily resiliently deformable. Thus, resistance when the reverse rotation restricting projection moves over the rotation restricting portion is even lower.

The guide groove in one embodiment includes a guiding opening that is open in an outer peripheral edge of the arm and a guiding inclined portion is inclined to make the guide groove deeper from an edge of the bearing hole toward the guiding opening. The reverse rotation restricting projection may be disposed in an area on a side closer to the guiding opening than the guiding inclined portion. According to this configuration, an area of the guide groove on the side closer to the guiding opening than the guiding inclined portion is thin and easily resiliently deformed. Thus, the reverse rotation restricting projection easily moves over the rotation restricting portion.

In one embodiment, a separation restricting portion is formed on the housing. The separation restricting portion is capable of restricting the separation of the lever from the housing by being locked to the reverse rotation restricting projection in the process of assembling the lever with the housing. According to this configuration, the reverse rotation restricting projection has a function of restricting reverse rotation of the lever and a function of restricting the separation of the lever from the housing.

DETAILED DESCRIPTION

Figure 1:
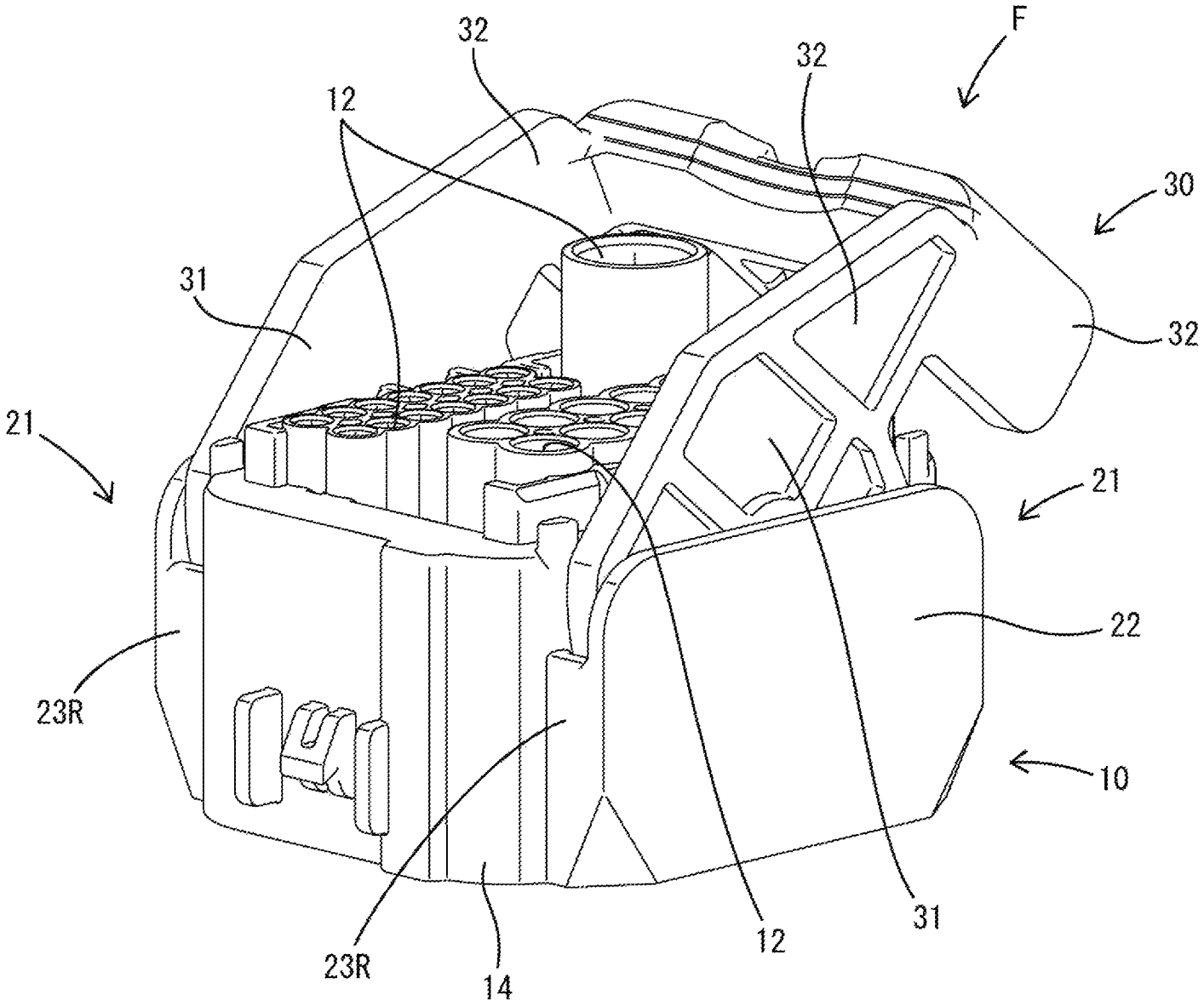
FIG. 1 is a perspective view of a lever-type connector according to one embodiment.
Figure 2:
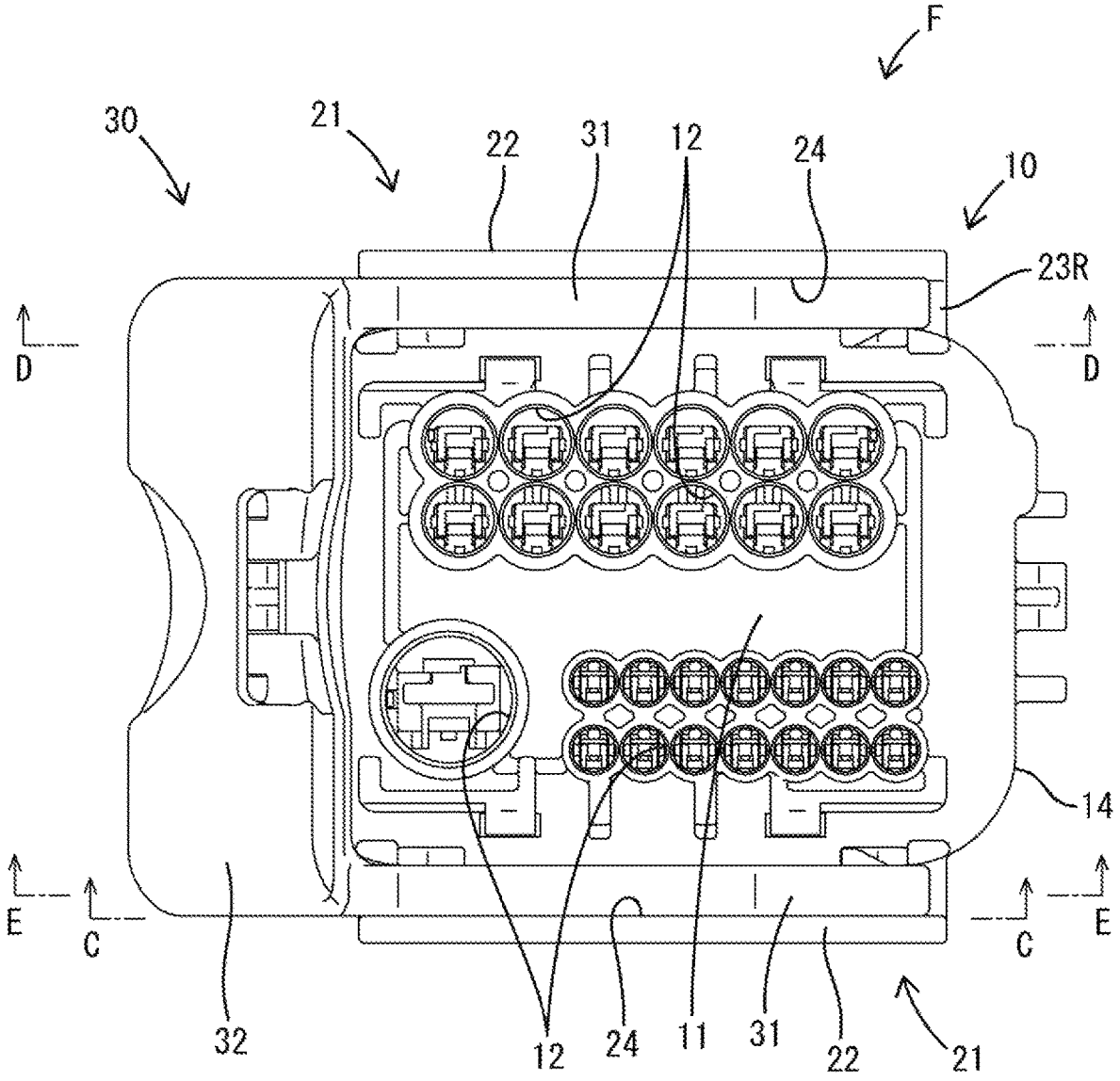
FIG. 2 is a plan view of the lever-type connector.
Figure 3:
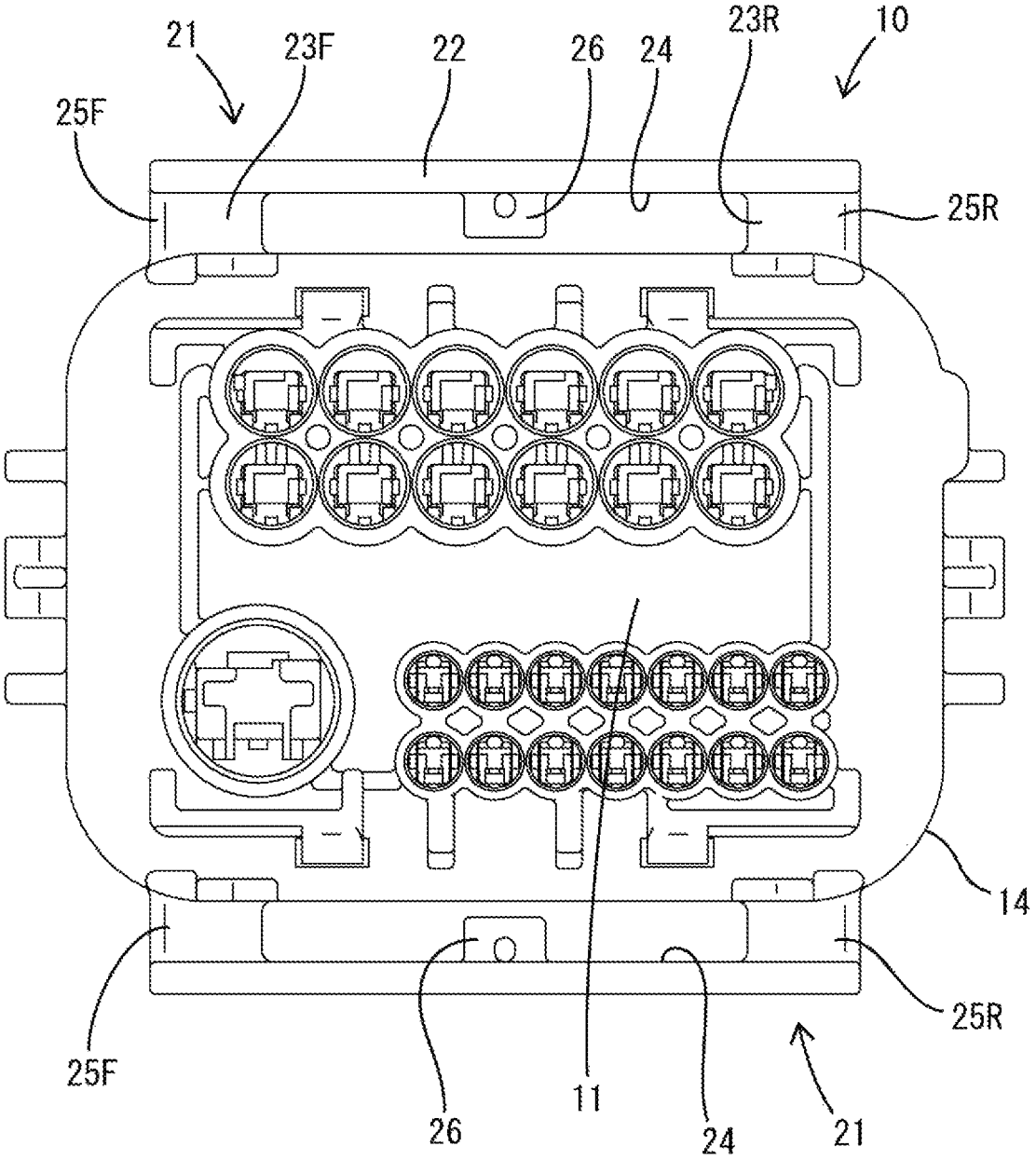
FIG. 3 is a plan view of a housing.
Figure 4:
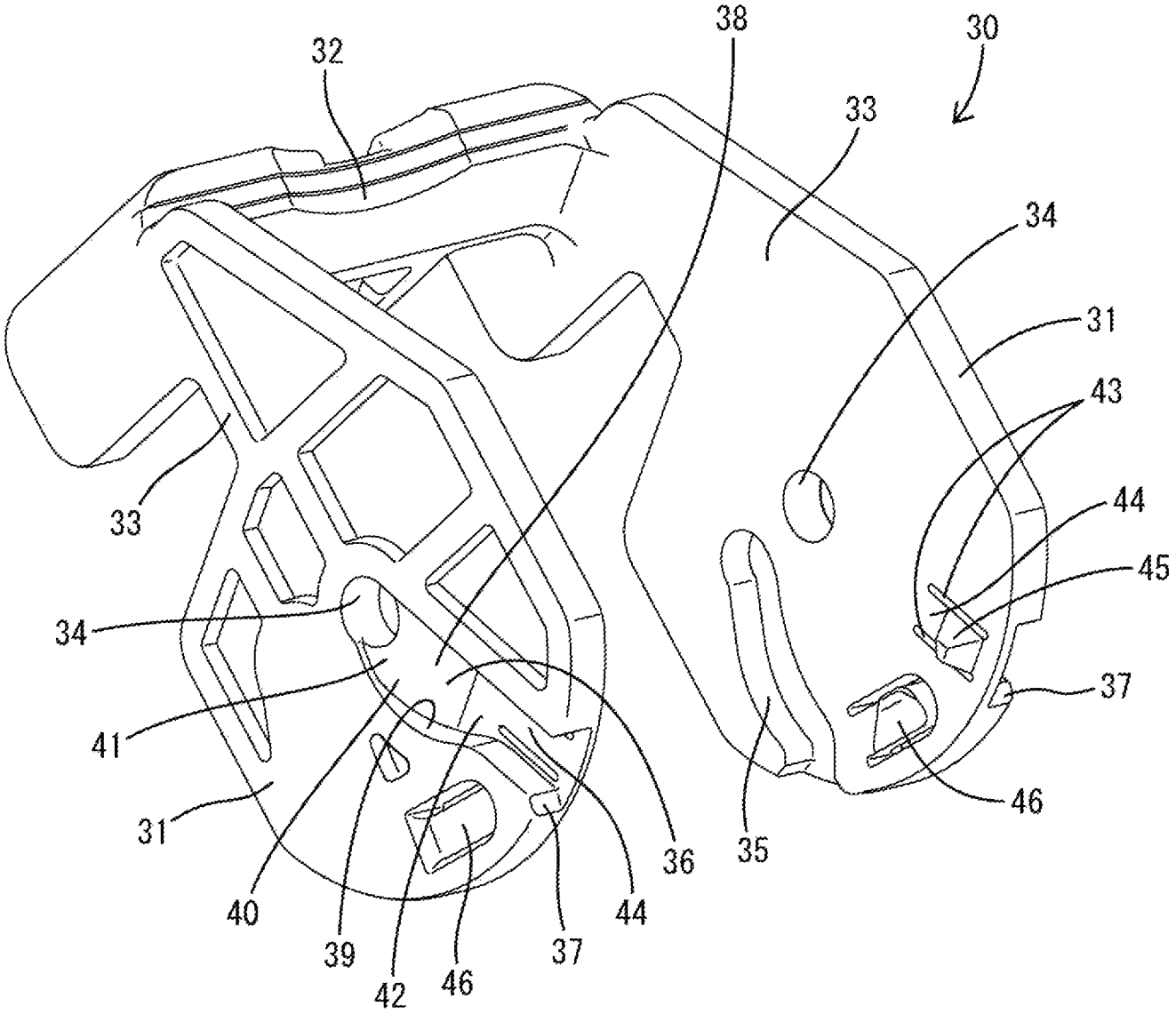
FIG. 4 is a perspective view of a lever.
Figure 5:
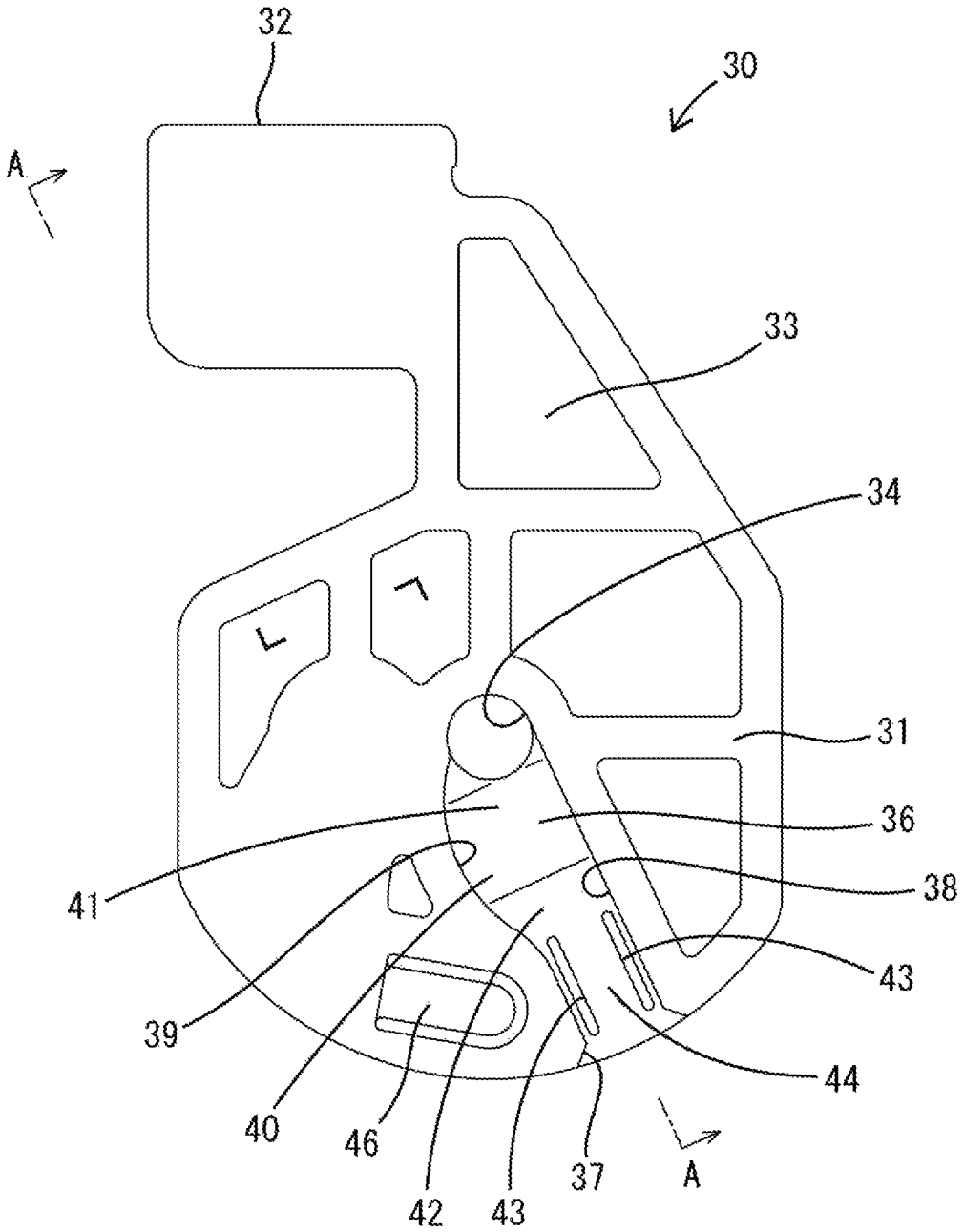
FIG. 5 is a side view of the lever.
Figure 6:
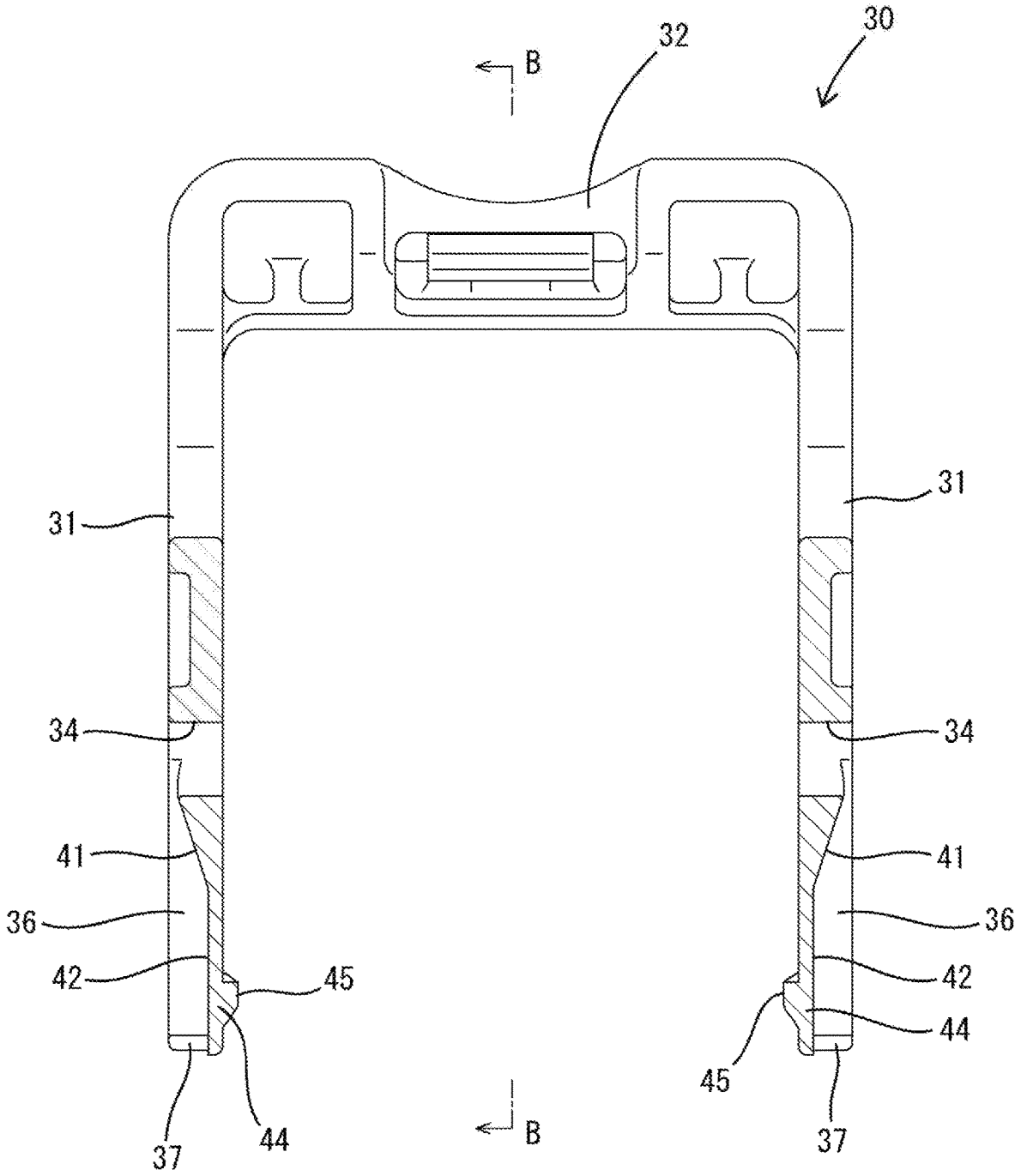
FIG. 6 is a section along A-A of FIG. 5.
Figure 7:
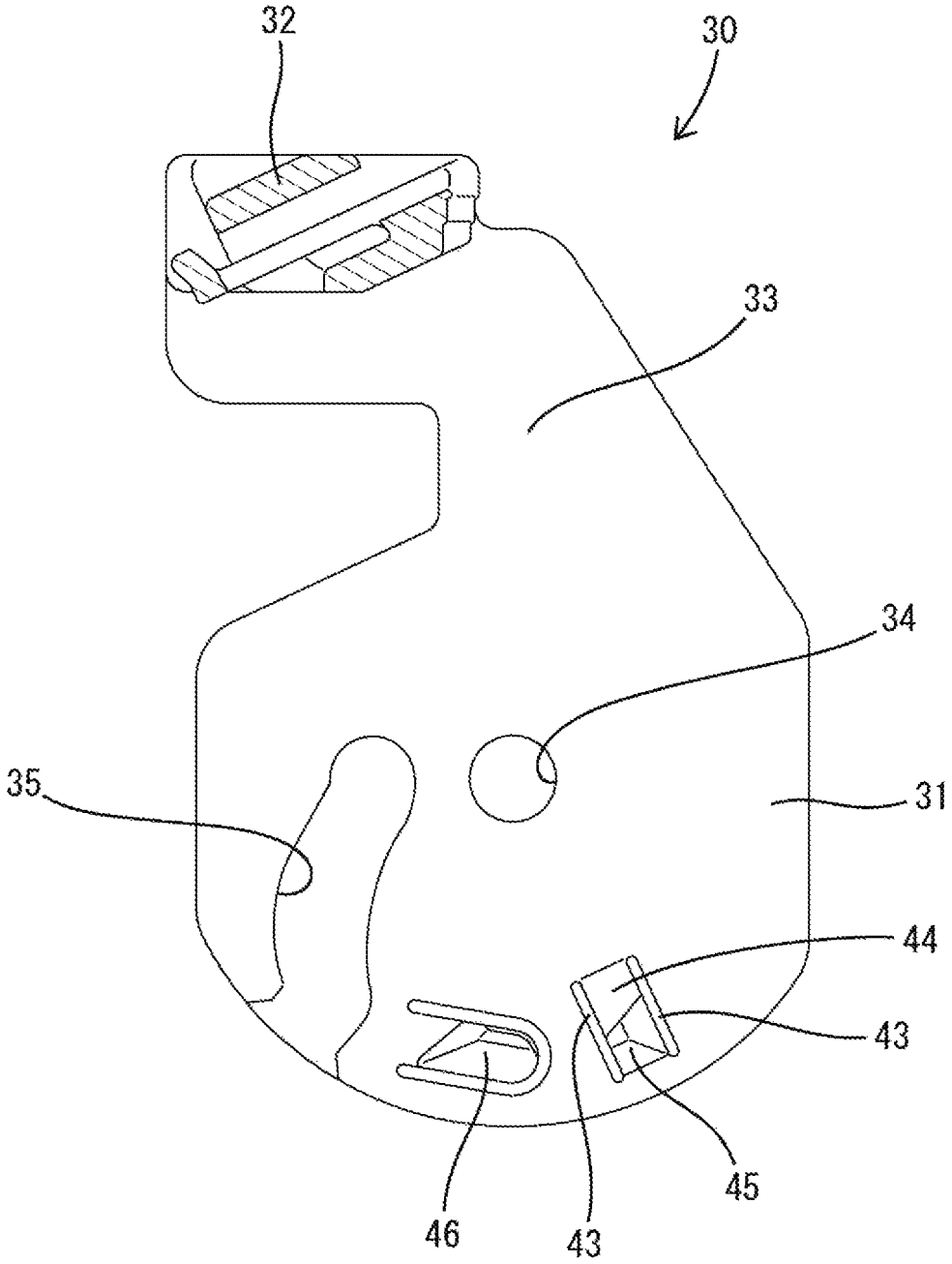
FIG. 7 is a section along B-B of FIG. 6.

One embodiment of the invention is described with reference to FIGS. 1 to 15. Note that, in the following description, a left side in FIGS. 2, 3, 5, 7 to 15 is defined as a front side concerning a front-rear direction. Upper and lower sides shown in FIGS. 1, 4 to 15 are defined as upper and lower sides concerning a vertical direction.

A lever-type connector F of this embodiment includes a housing 10 made of synthetic resin, a lever 30 made of synthetic resin and a plurality of terminal fittings (not shown). The housing 10 includes a block-like terminal accommodating portion 11, a peripheral wall portion 14 surrounding both front and rear outer surfaces and both left and right outer side surfaces of the terminal accommodating portion 11 over the entire periphery, and a pair of bilaterally symmetrical lever accommodating portions 21 spaced apart from and facing both front and rear outer surfaces of the peripheral wall portion 14. A plurality of long and narrow cavities 12 extending in the vertical direction are formed in the terminal accommodating portion 11 while being aligned in the front-rear and lateral directions.

The plurality of terminal fittings are individually inserted into the plurality of cavities 12 from above the housing 10. Wires 28 are individually connected to upper end parts of the plurality of terminal fittings, and a plurality of the wires 28 are drawn out upward from a wire draw-out surface 13 on the upper end surface of the housing 10, thereby constituting a wire bundle 27. Since openings in the upper ends of the cavities 12 are disposed substantially over the entire wire draw-out surface 13, the wire bundle 27 composed of the plurality of wires 28 spreads out more in the front-rear and lateral directions toward the wire draw-out surface 13.

An upper end part of the peripheral wall portion 14 is connected to the outer peripheral surface of the terminal accommodating portion 11. A space formed between the terminal accommodating portion 11 and the peripheral wall portion 14 serves as a connection space 15 open in the lower surface of the housing 10. Both left and right side wall portions 16 constituting the peripheral wall portion 14 are formed with cutout portions 17 whose side view shapes are front-rear symmetrical. The cutout portion 17 penetrates from the inner surface to the outer surface of the side wall portion 16 and is open in the lower end edge of the side wall portion 16. An upper edge part of the side wall portion 16, i.e. an area of the side wall portion 16 facing the upper end edge of the cutout portion 17, serves as a separation restricting portion 18.

The side wall portion 16 is formed with a front cutout groove 19F and a rear cutout groove 19R front-rear symmetrical and disposed at front and rear sides of the cutout portion 17. The front cutout groove 19F penetrates from the inner surface to the outer surface of the side wall portion 16 and is open in the upper end edge of the side wall portion 16. The rear cutout groove 19R penetrates from the inner surface to the outer surface of the side wall portion 16 and is open in the upper end edge of the side wall portion 16. An area of the side wall portion 16 between a lower end part of the front cutout groove 19F and a front end edge part of the cutout portion 17 serves as a front rotation restricting portion 20R (rotation restricting portion as claimed). An area of the side wall portion 16 between a lower end part of the rear cutout groove 19R and a rear end edge part of the cutout portion 17 serves as a rear rotation restricting portion 20R (rotation restricting portion as claimed).

Each of the pair of lever accommodating portions 21 has a front-rear symmetrical side view shape and includes a wall-like portion 22, a front coupling portion 23F and a rear coupling portion 23R. The wall-like portion 22 is in the form of a flat plate spaced apart from and disposed to face the outer surface of the left or right side wall portion 16. The front coupling portion 23F is long and narrow in the vertical direction as a whole and couples a front end edge part of the wall-like portion 22 and an area of the outer side surface of the side wall portion 16 in front of lower end areas of the cutout portion 17 and the front cutout groove 19F. The rear coupling portion 23R is long and narrow in the vertical direction as a whole and couples the front end edge part of the wall-like portion 22 and an area of the outer side surface of the side wall portion 16 behind lower end areas of the cutout portion 17 and the rear cutout groove 19R.

Spaces defined by the both left and right lever accommodating portions 21 and the peripheral wall portion 14 (both left and right side wall portions 16) serve as a pair of accommodation spaces 24 having a plan view shape long and narrow in the front-rear direction. The accommodation spaces 24 are open in the upper and lower surfaces of the housing 10. An upper end part of the front coupling portion 23F functions as a front posture suppressing portion 25F (posture suppressing portion as claimed) facing the inside of the accommodation space 24. An upper end part of the rear coupling portion 23R functions as a rear posture suppressing portion 25R (posture suppressing portion as claimed) facing the inside of the accommodation space 24.

A pair of bilaterally symmetrical support shafts 26 having axes oriented in the lateral direction are formed to project on upper end parts of the inner surfaces of the both left and right wall-like portions 22. The support shaft 26 is arranged in a center of the lever accommodating portion 21 in the front-rear direction. The arm portion 31 of the lever 30 is accommodated in each accommodation space 24 and a bearing hole 34 of the arm portion 31 is fit to the support shaft 26. The lever 30 is rotatable with the support shafts 26 as supporting points. In the process of assembling the lever 30 with the housing 10, the outer peripheral edges of the arm portions 31 can come into contact with the front or rear posture suppressing portions 25F, 25R. If the arm portions 31 come into contact with the front or rear posture suppressing portions 25F, 25R in the process of assembling the lever 30 with the housing 10, a posture change of the lever 30 can be suppressed.

The lever 30 includes the pair of bilaterally symmetrical arm portions 31 and an operating portion 32. The operating portion 32 couples extending end parts of a pair of bilaterally symmetrical extending portions 33 projecting radially outward, out of the both arm portions 31. The arm portions 31 are substantially in the form of flat plates whose plate thickness direction is oriented in the lateral direction (direction parallel to the axes of the support shafts 26), and continuous and flush with each other. The penetrating bearing hole 34 is formed substantially in a central part of the arm portion 31 when viewed laterally. A cam groove 35 extending from the outer peripheral edge of the arm portion 31 toward the bearing hole 34 is formed in the inner surface (surface facing the side wall portion 16) of the arm portion 31.

A guide groove 36 extending from the outer peripheral edge of the arm portion 31 to the bearing hole 34 is formed in the outer surface of the arm portion 31. The guide groove 36 functions as a guiding path for guiding the support shaft 26 to the bearing hole 34 in the process of assembling the lever 30 with the housing 10. An end part of the guide groove 36 on a side opposite to the bearing hole 34 is open as a guiding opening 37 in the outer peripheral edge of the arm portion 31. An opening width of the guiding opening 37 is substantially equal to an inner diameter of the bearing hole 34 and an outer diameter of the support shaft 26.

In a side view, the guide groove 36 is disposed in an area different from the cam groove 35. In assembling the lever 30 with the housing 10, the arm portions 31 are inserted into the accommodation spaces 24 from above the housing 10 in such a posture that the guiding openings 37 of the guide grooves 36 are open downward (direction substantially the same as an assembling direction of the lever 30 with the housing 10).

The guide groove 36 is composed of a shortest guiding portion 38 linearly connecting the guiding opening 37 and the bearing hole 34 and a retracted portion 39 communicating with the shortest guiding portion 38. A formation area of the retracted portion 39 is a range from a position closer to the bearing hole 34 than the guiding opening 37 to a position on an opening edge part of the bearing hole 34. When the arm portion 31 is inserted into the lever accommodating portion 21 (accommodation space 24) in such an orientation that the guiding opening 37 of the guide groove 36 is open downward, the retracted portion 39 bulges from the shortest guiding portion 38 (virtual path connecting the guiding opening 37 and the bearing hole 34) toward the front posture suppressing portion 25F in a side view. In the side view, an edge part of the retracted portion 39 on the side of the front posture suppressing portion 25F is constituted only by a curve.

The shortest guiding portion 38 functions as a guiding path for guiding the support shaft 26 from the guiding opening 37 to the bearing hole 34 in the process of assembling the lever 30 with the housing 10. The retracted portion 39 functions as a guiding path for guiding the support shaft 26 from a position slightly closer to the bearing hole 34 than the guiding opening 37 to the bearing hole 34 in the process of assembling the lever 30 with the housing 10. An area of the guide groove 36 where the retracted portion 39 is formed serves as a wide portion 40 having a larger width than the guiding opening 37 and the bearing hole 34. A maximum width of the wide portion 40 is smaller than twice the outer diameter of the support shaft 26. A part of the guiding path of the retracted portion 39 is a path common to the guiding path of the shortest guiding portion 38.

The extending portion 33 of the lever 30 extends radially outward from an area of the outer peripheral edge of the arm portion 31 on a side opposite to the guiding opening 37 across the bearing hole 34. The operating portion 32 couples front (side toward which the retracted portions 39 protrude from the shortest guiding portions 38) side edge parts of the extending end parts of the extending portions 33. Since the guiding openings 37 are open downward in the process of assembling the lever 30 with the housing 10, the extending portions 33 and the operating portion 32 are located above the arm portions 31. In the process of assembling the lever 30 with the housing 10, the operating portion 32 moves forward of and near the wire bundle 27 drawn out upward from the wire draw-out surface 13.

The guide groove 36 is formed with a guiding inclined portion 41 inclined to make the guide groove 36 gradually deeper from a hole edge part of the bearing hole 34 toward the guiding opening 37. A formation area of the guiding inclined portion 41 is a range from the hole edge part of the bearing hole 34 to a position closer to the bearing hole 34 than an end part of the retracted portion 39 on the side of the guiding opening 37. An area of the guide groove 36 from the guiding inclined portion 41 to the guiding opening 37 serves as a deep groove portion 42 having a constant depth. Thus, the wide portion 40 is composed of the guiding inclined portion 41 and the deep groove portion 42. An area of the arm portion 31 where the deep groove portion 42 is formed serves as a thin portion thinner than an area where the guide groove 36 and the cam groove 35 are not formed.

The deep groove portion 42 (thin potion) is formed with a pair of slits 43 penetrating through the deep groove portion 42 in a plate thickness direction of the arm portion 31. A formation range of the pair of slits 43 is an area of the shortest guiding portion 38 not common to the retracted portion 39, i.e. an area near the guiding opening 37. The pair of slits 43 are linear and parallel to a length direction of the shortest guiding portion 38, and disposed along opposite widthwise end edges of the shortest guiding portion 38. An area of the deep groove portion 42 (thin portion) sandwiched between the pair of slits 43 serves as a deformation facilitating portion 44 having lower flexural rigidity than the entire area of the guiding inclined portion 41 and an area of the deep groove portion 42 not sandwiched between the pair of slits 43.

A pair of bilaterally symmetrical reverse rotation restricting projections 45 are formed on the inner surfaces (surfaces opposite to the surfaces where the guide grooves 36 are formed) of the pair of arm portions 31. The reverse rotation restricting projection 45 is disposed within the range of the formation area of the guide groove 36 in a side view. In particular, the entire reverse rotation restricting projection 45 is disposed in the deformation facilitating portion 44 sandwiched between the pair of slits 43, and the reverse rotation restricting projection 45 projects toward the outer side surface of the housing 10 (terminal accommodating portion 11). As the deformation facilitating portion 41 is resiliently deformed, the reverse rotation restricting projection 45 is displaced in a direction away from the outer side surface of the terminal accommodating portion 11.

A pair of bilaterally symmetrical initial position holding projections 46 are formed on the inner surfaces (same surfaces as those formed with the reverse rotation restricting projections 45) of the pair of arm portions 31. The initial position holding projection 46 is disposed at a position not corresponding to the guide groove 36 in a side view, i.e. in an area different from the formation area of the guide groove 36. In particular, the initial position holding projection 46 is disposed between the cam groove 35 and the guide groove 36 in a circumferential direction about the support shaft 26 (bearing hole 34) and disposed to face the reverse rotation restricting projection 45 in the circumferential direction. Since being enclosed in a substantially U-shaped clearance, the initial position holding projection 46 is resiliently deformable in the plate thickness direction of the arm portion 31.

The lever 30 is assembled with the housing 10 with the arm portions 31 substantially entirely accommodated in the accommodation spaces 24 of the lever accommodating portions 21, the bearing holes 34 fit to the support shafts 26 and the extending portions 33 and the operating portion 32 caused to project outward from upper end openings of the accommodation spaces 24. The lever 30 is rotatable about the support shafts 26 and the bearing holes 34 between an initial position (see FIGS. 12 to 14) where the lever 30 waits ready for connection to the mating connector M and a connection position (see FIG. 15) where the connection to the mating connector M is completed.

Figure 12:
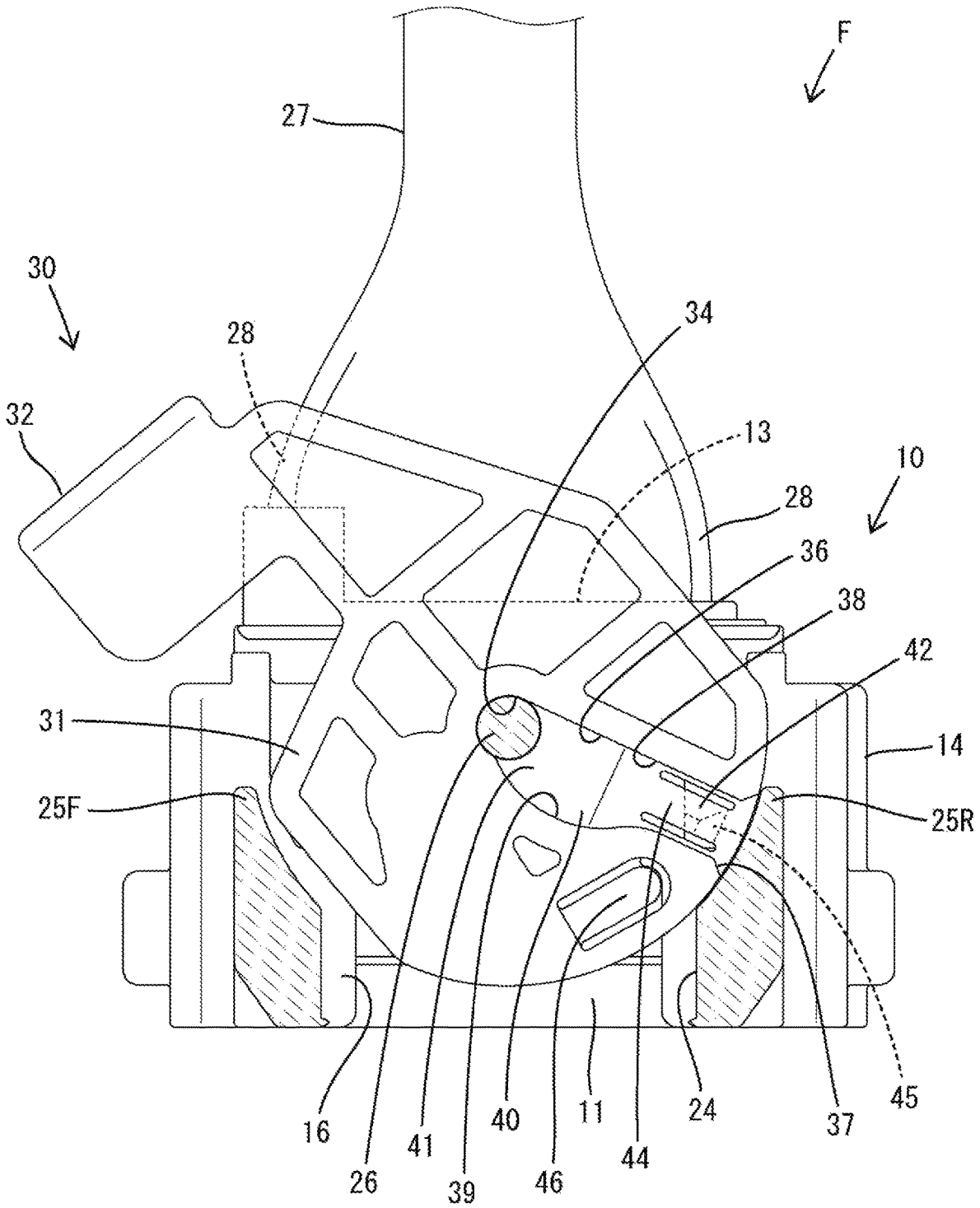
FIG. 12 is a section along C-C of FIG. 2 showing a state where the assembling of the lever with the housing is completed and the lever is held at an initial position.
Figure 13:
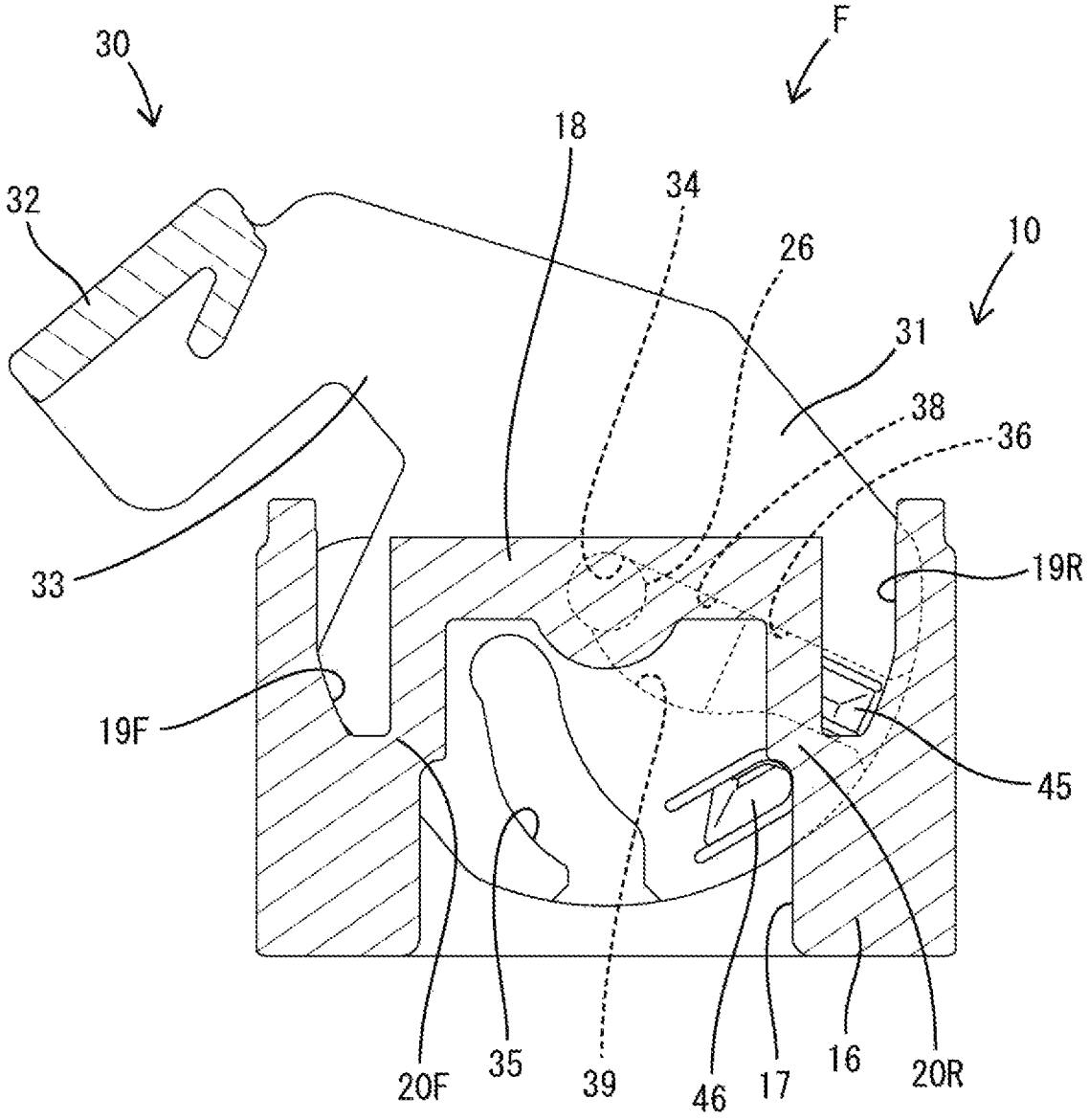
FIG. 13 is a section along D-D of FIG. 2 showing a state where the assembling of the lever with the housing is completed and the lever is held at the initial position.
Figure 14:
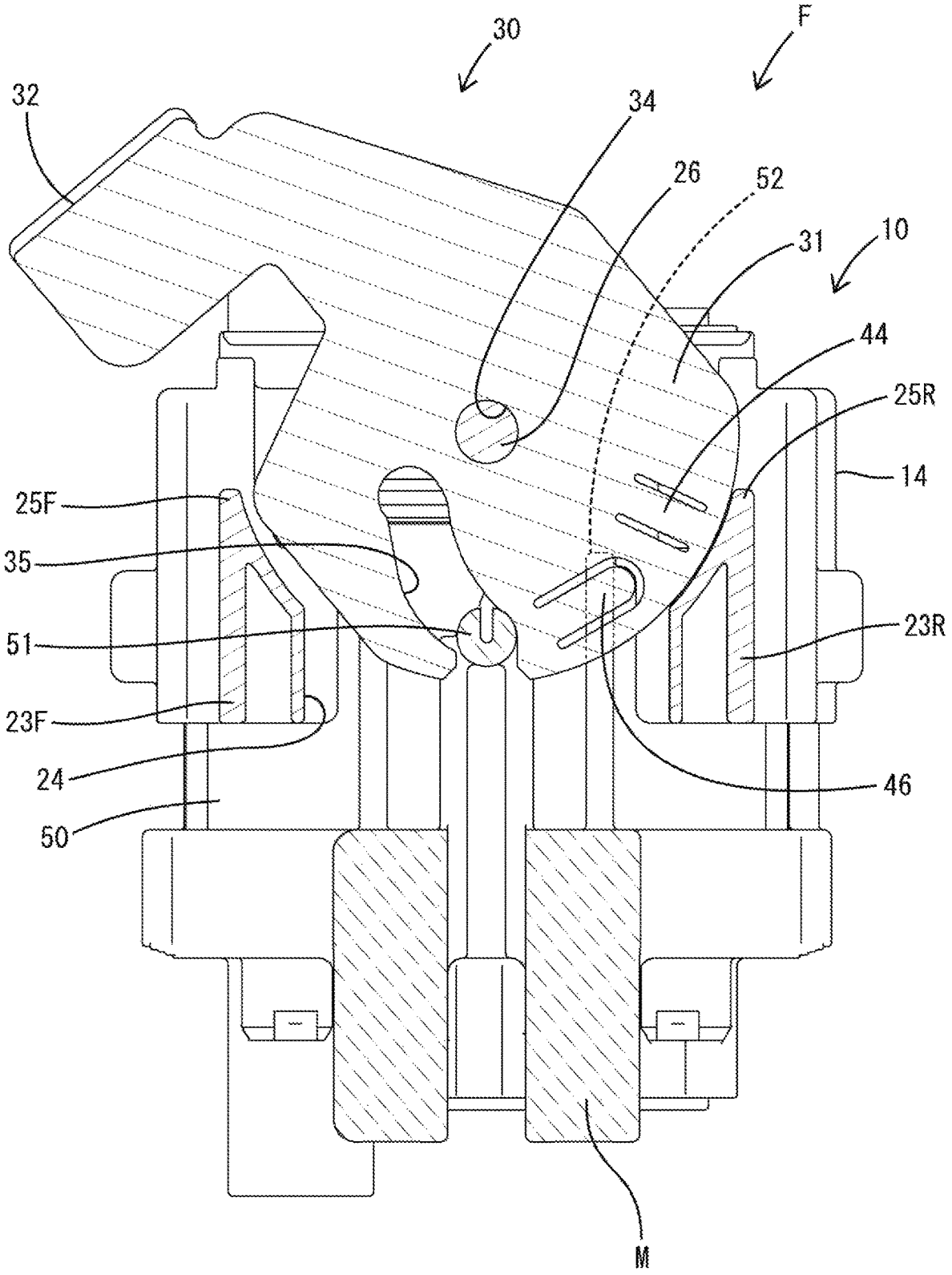
FIG. 14 is a section along E-E of FIG. 2 showing a state reached when the connection of the lever-type connector and a mating connector is started and cam followers of the mating connector enter the entrances of cam grooves.

In connecting the lever-type connector F to the mating connector M, the reverse rotation restricting projections 45 and the initial position holding projections 46 are locked to the rotation restricting portions 20 to sandwich the rotation restricting portions 20 in the circumferential direction as shown in FIG. 13, whereby the lever 30 is held at the initial position. At this time, the operating portion 32 is located in front of the wire bundle 27. In this state, as shown in FIG. 14, the receptacle 50 of the mating connector M is lightly fit into the connection space 15 from below and cam followers 51 of the mating connector M are caused to enter the entrances of the cam grooves 35. Then, releasing portions 52 of the mating connector M resiliently deform the initial position holding projections 46 to separate the initial position holding projections 46 from the rotation restricting portions 20. Thus, the lever 30 becomes rotatable toward the connection position. However, since the reverse rotation restricting projections 45 are locked to the rotation restricting portions 20, the rotation of the lever 30 toward a side opposite to the connection position (clockwise direction in FIGS. 8 to 15) is restricted.

Figure 15:
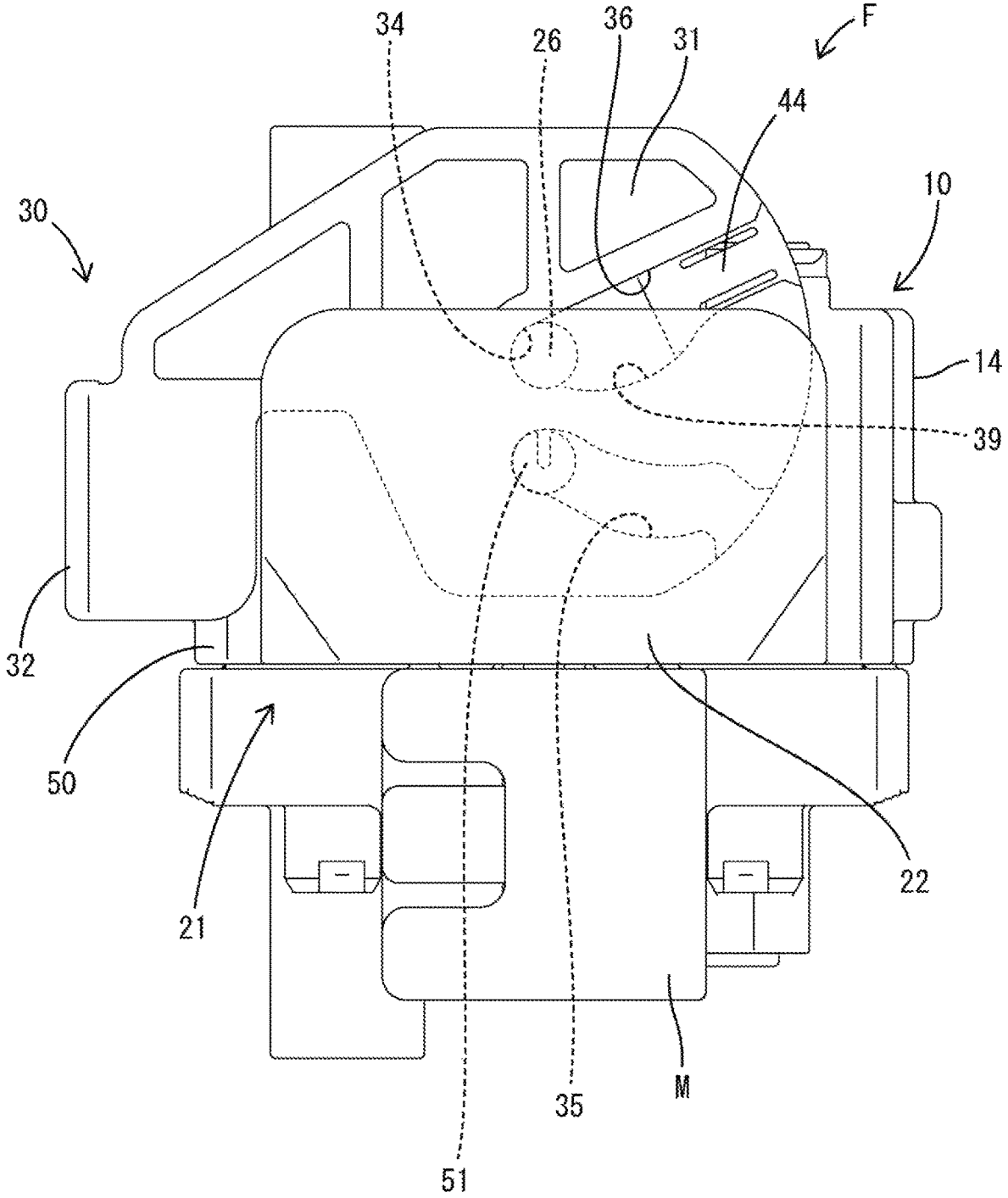
FIG. 15 is a side view showing a state where the connection of the lever-type connector and the mating connector is completed.

If the operating portion 32 is moved downward in this state, the lever 30 rotates toward the connection position and the lever-type connector F and the mating connector M are connected as shown in FIG. 15 by a cam action by the engagement of the cam grooves 35 and the cam followers 51. In separating the both connectors F, M, the lever 30 may be rotated from the connection position to the initial position and, thereafter, the both connectors F, M may be vertically pulled apart. If the lever 30 is returned to the initial position, the initial position holding projections 46 are locked to the rotation restricting portions 20, thereby restricting the rotation of the lever 30 toward the connection position. Simultaneously with this, the reverse rotation restricting projections 45 are locked to the rotation restricting portions 20, thereby restricting the rotation of the lever 30 in a direction opposite to the one toward the connection position.

Figure 8:
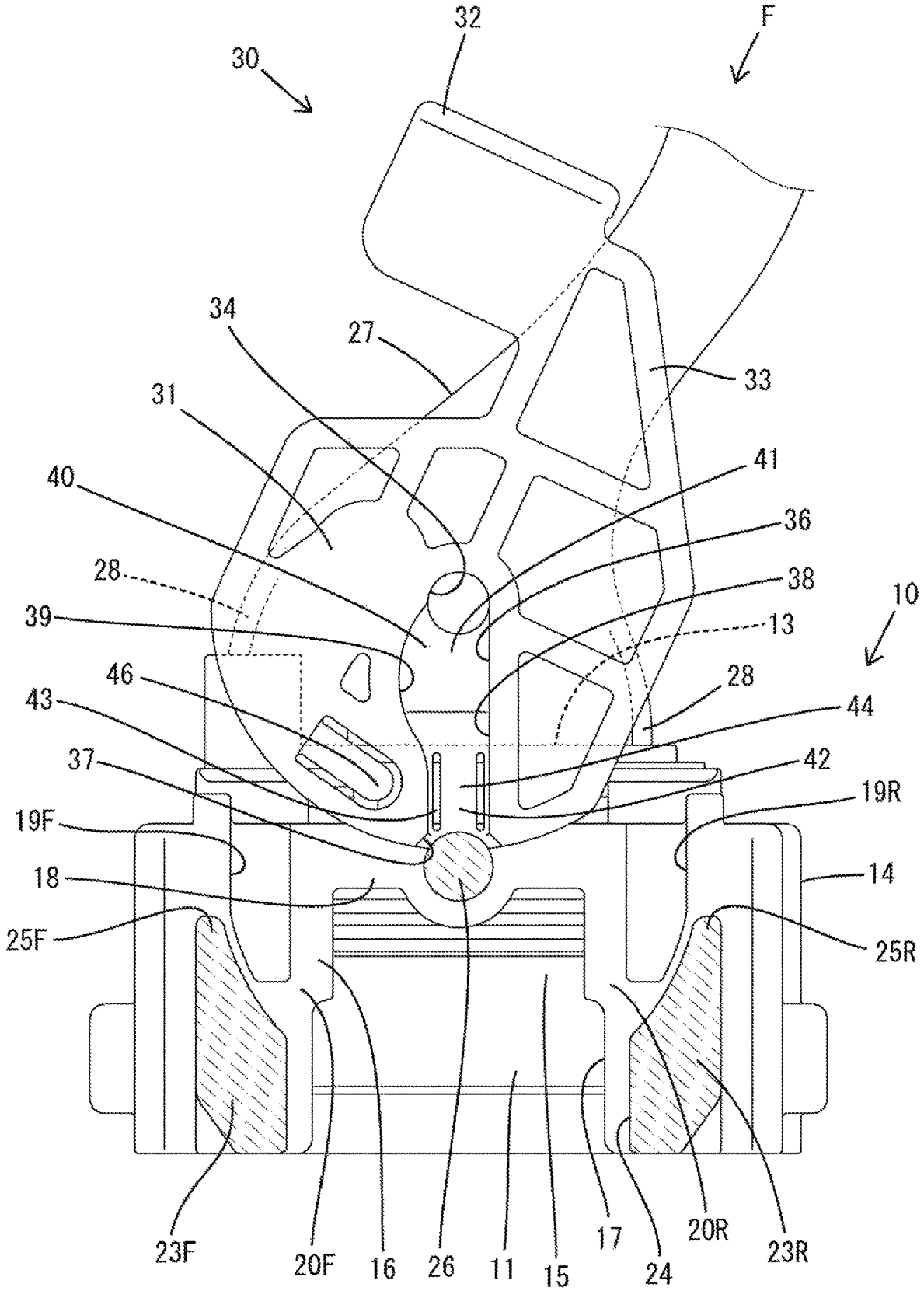
FIG. 8 is a section along C-C of FIG. 2 showing a state when the assembling of the lever with the housing is started.

Next, an operation of assembling the lever 30 with the housing 10 is described. The arm portions 31 of the lever 30 are inserted into the accommodation spaces 24 from above the housing 10 such that the operating portion 32 is located in front of the wire bundle 27 with the guiding openings 37 of the guide grooves 36 open downward. At this time, as shown in FIG. 8, the wire bundle 27 is pushed rearward by the operating portion 32, but a part of the wire bundle 27 pushed by the operating portion 32 is distant from the terminal accommodating portion 11 (wire draw-out surface 13). Thus, resistance when the wire bundle 27 is bent rearwardly is small.

Figure 9:
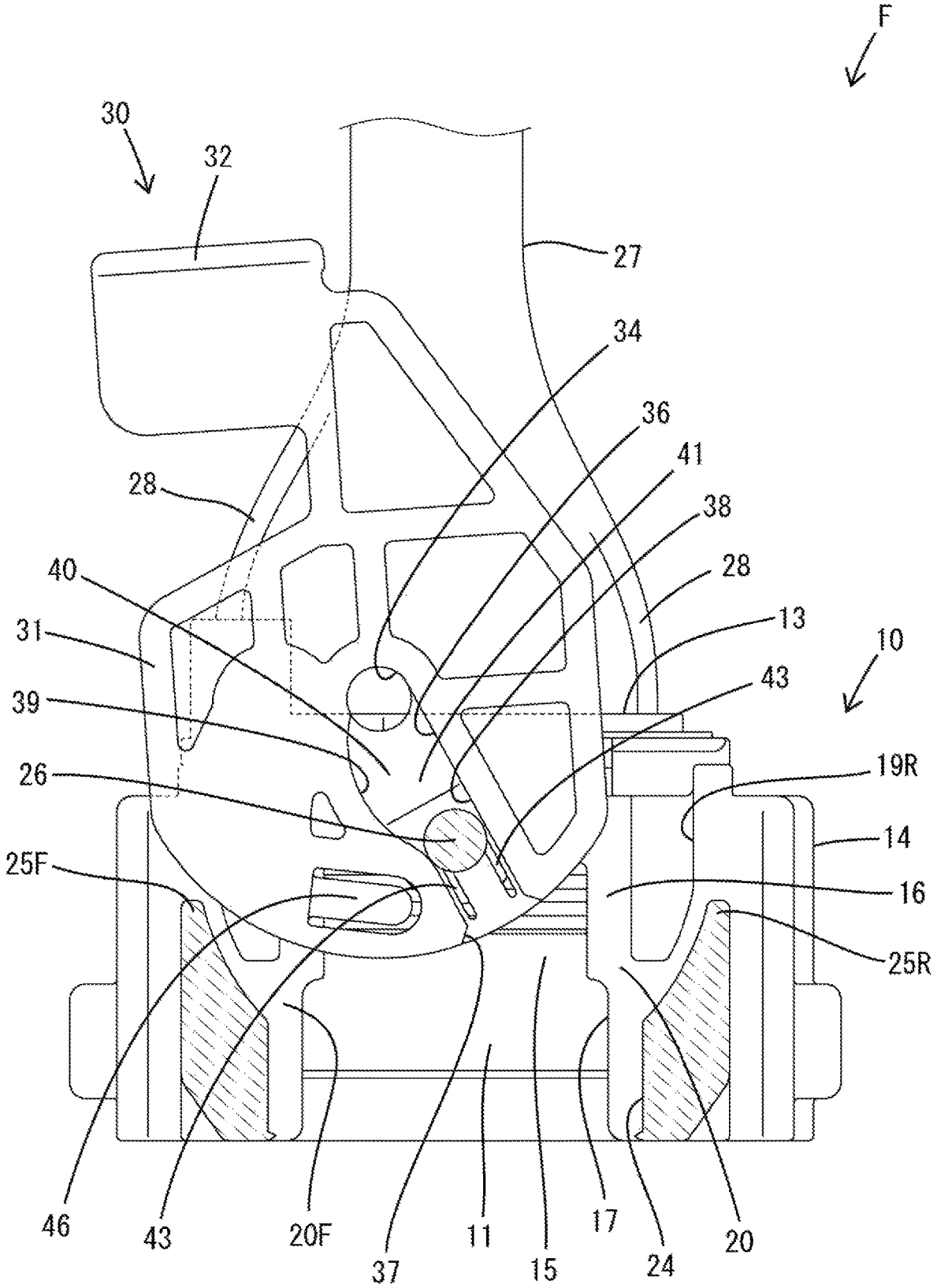
FIG. 9 is a section along C-C of FIG. 2 showing a state reached when support shafts move to positions immediately before retracted portions in the process of assembling the lever with the housing.
Figure 10:
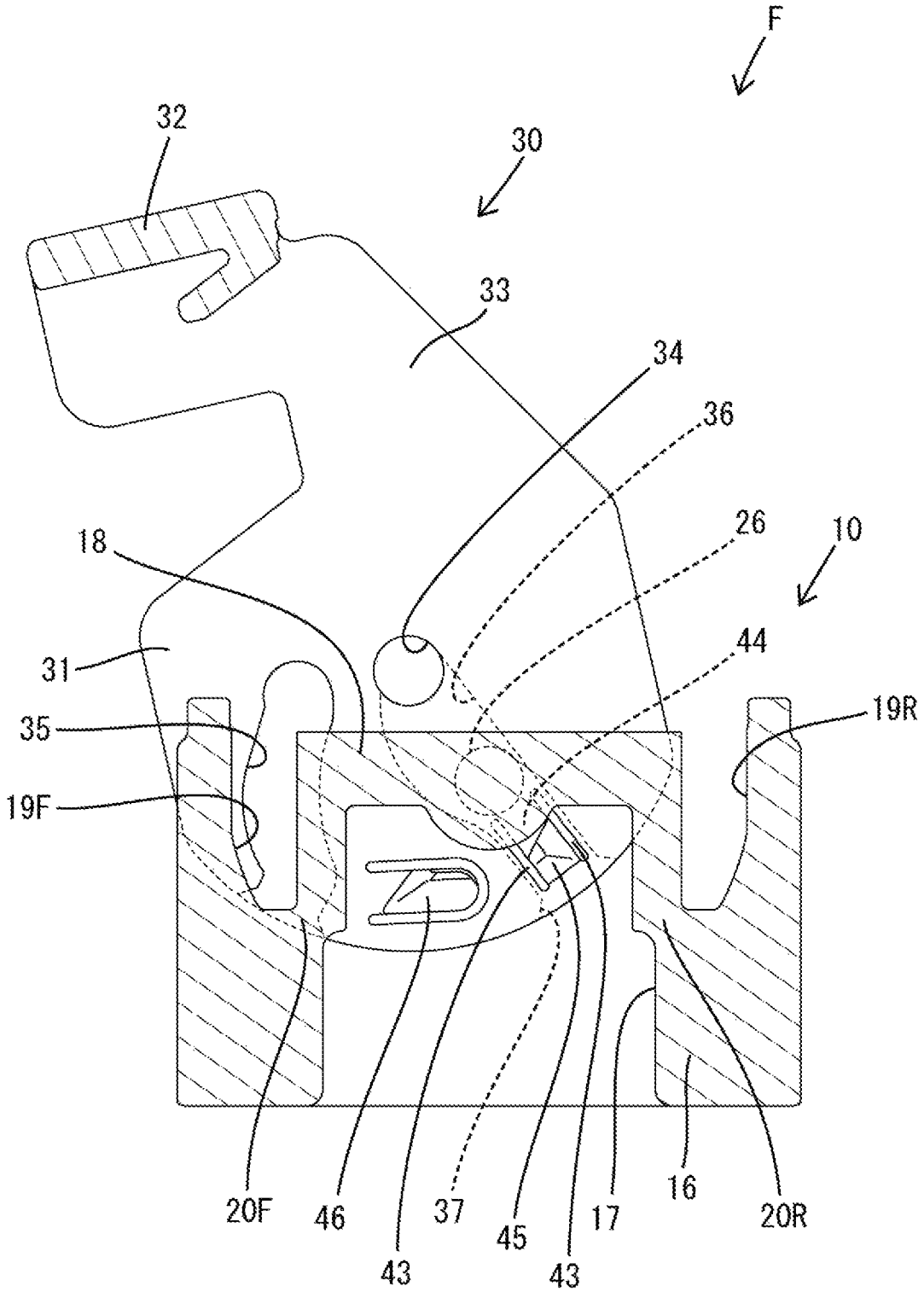
FIG. 10 is a section along D-D of FIG. 2 showing a state reached when the lever is further assembled from the state of FIG. 9 and reverse rotation restricting projections are locked to separation restricting portions.

The support shafts 26 are caused to enter the guiding openings 37 when the arm portions 31 are inserted into the accommodation spaces 24. If the entire lever 30 is displaced downward in this state, the support shafts 26 move in areas of the shortest guiding portions 38 not common to the retracted portions 39 as shown in FIG. 9, further move toward the bearing holes 34 in the guide grooves 36 and reach the wide portions 40 as shown in FIG. 10. As the lever 30 is assembled, the operating portion 32 approaches the wire draw-out surface 13. Since the wire bundle 27 spreads out more in the front-rear and lateral directions with intervals between the wires 28 increasing toward the wire draw-out surface 13, the operating portion 32 interferes with the wire bundle 27 from front.

Here, since the respective wires 28 are individually inserted into the plurality of cavities 12 distributed over a wide range of the wire draw-out surface 13, it is difficult to deform the wire bundle 27 spreading more toward the wire draw-out surface 13 of the housing 10. Thus, as the lever 30 is assembled, the operating portion 32 is displaced forward to avoid or alleviate interference with the wire bundle 27. Associated with this, the lever 30 is displaced to be inclined forward with the support shafts 26 substantially as supporting points. However, since the front posture suppressing portions 25F are present in front of and near the arm portions 31, the arm portions 31 come into contact with the front posture suppressing portions 25F by the lever 30 being inclined forward and an oblique forward displacement of the lever 30 and a forward displacement of the operating portion 32 are restricted.

If the forward displacement of the operating portion 32 is restricted, the operating portion 32 and the wire bundle 27 interfere. In addition, since the wire bundle 27 is spreading more toward the end, it becomes more difficult to avoid the interference of the operating portion 32 and the wire bundle 27 as the operating portion 32 approaches the wire draw-out surface 13. Since a positional relationship of the front posture suppressing portions 25F and the support shafts 26 is fixed, the posture of the lever 30 cannot be changed to be inclined forward with the arm portions 31 held in contact with the front posture suppressing portions 25F and the support shafts 26 remaining in the shortest guiding portions 38 of the guide grooves 36. If the operating portion 32 and the wire bundle 27 interfere more, the resistance of the assembling operation of the lever 30 increases to reduce workability.

Figure 11:
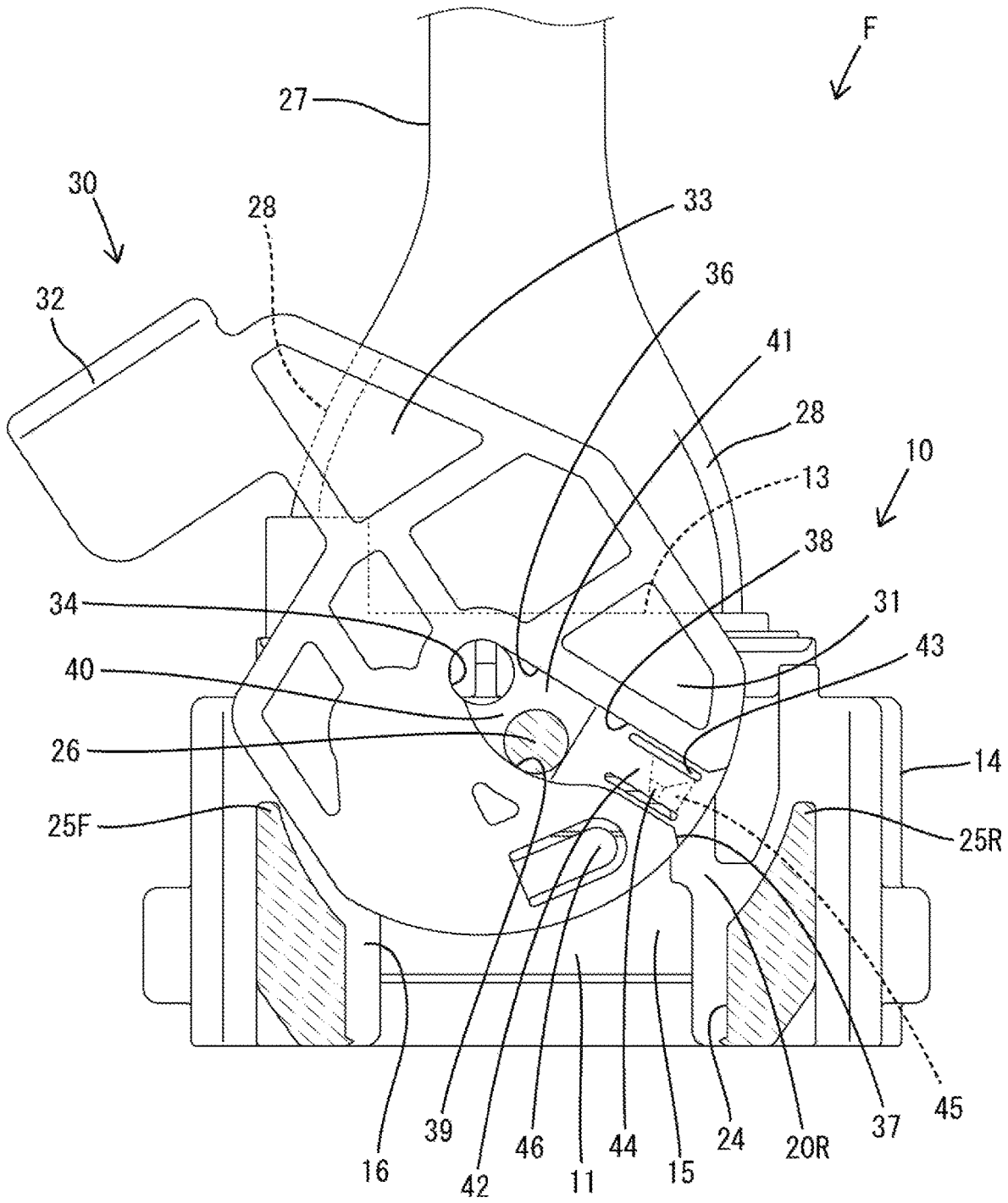
FIG. 11 is a section along C-C of FIG. 2 showing a state reached when the lever is further assembled from the state of FIG. 10 and the support shafts move in the retracted portions.

As a countermeasure against this, the retracted portions 39 are provided in the guide grooves 36. Since the retracted portion 39 is formed to protrude toward the front posture suppressing portion 25F from the shortest guiding portion 38, a sufficient clearance is formed between the arm portion 31 and the front posture suppressing portion 25F by a displacement of the support shaft 26 into the retracted portion 39. By these clearances, the posture of the lever 30 can be changed to be inclined forward with the support shafts 26 substantially as the supporting points. As shown in FIG. 11, the lever 30 is inclined forward, whereby the operating portion 32 is displaced forward to be retracted from the wire bundle 27. In this way, the interference of the operating portion 32 and the wire bundle 27 is more easily avoided, wherefore workability in assembling the lever 30 is good.

Further, since the guiding path for the support shaft 26 from the guiding opening 37 to the guiding inclined portion 41 is the deep groove portion 42 having a relatively large depth, even if the projecting end of the support shaft 26 slides in contact with the deep groove portion 42, sliding resistance is small. Thus, resistance in assembling the lever 30 can also be small. Since the projecting end of the support shaft 26 slides in contact with the guiding inclined portion 41 if the support shaft 26 moves to the guiding inclined portion 41, sliding resistance gradually increases. When the support shaft 26 reaches the bearing hole 34 and is fit thereinto, sliding resistance between the support shaft 26 and the guiding inclined portion 41 disappears at once. Thus, the worker can feel that the support shaft 26 has been fit into the bearing hole 34 by this disappearance of the sliding resistance. In the above manner, the operation of assembling the lever 30 with the housing 10 is completed.

In the process of assembling the lever 30 with the housing 10, the reverse rotation restricting projections 45 move over the separation restricting portions 18 and enter the cutout portions 17. If the reverse rotation restricting projections 45 enter the cutout portions 17, the reverse rotation restricting projections 45 are locked to the separation restricting portions 18, whereby the lever 30 is held temporarily assembled with the housing 10 and not possibly separated from the housing 10.

Further, the reverse rotation restricting projections 45 are displaced laterally outward (directions away from the side wall portions 16 and toward the wall-like portions 22) integrally with the deformation facilitating portions 44 in moving over the separation restricting portions 18. Since the deformation facilitating portions 44 are more easily resiliently deformed than thick areas of the arm portions 31 where the guide grooves 36 and the cam grooves 35 are not formed, resistance when the reverse rotation restricting projections 45 move over the separation restricting portions 18 can be small.

Further, in the assembling process of the lever 30, the lever 30 is inclined forward in a final stage of the process, whereby the reverse rotation restricting projections 45 can be caused to enter the rear cutout grooves 19R to hold the lever 30 at the initial position simultaneously with the completion of the assembling of the lever 30. In this case, as shown in FIGS. 11 and 12, the reverse rotation restricting projections 45 move over areas between rear end parts of the separation restricting portions 18 or the cutout portions 17 of the side wall portions 16 and the rear cutout grooves 19R and enter the rear cutout grooves 19R. Since the deformation facilitating portions 44 formed with the reverse rotation restricting projections 45, have low flexural rigidity as described above, resistance when the reverse rotation restricting projections 45 enter the rear cutout grooves 19R can be small.

As described above, the lever-type connector F of this embodiment includes the housing 10 having the support shafts 26 formed on the outer side surfaces and having the wire bundle 27 drawn out from the wire draw-out surface 13, and the lever 30 having the arm portions 31. The front posture suppressing portions 25F for suppressing a posture change of the lever 30 when the outer peripheral edges of the arm portions 31 come into contact in the process of assembling the lever 30 with the housing 10 are formed on the outer side surfaces of the housing 10. The lever 30 is formed with the operating portion 32 extending from the outer peripheral edges of the arm portions 31 and configured to be displaced to approach the wire draw-out surface 13 in the process of assembling the lever 30 with the housing 10.

The arm portion 31 is formed with the bearing hole 34 for rotatably supporting the lever 30 on the housing 10 by being fit to the support shaft 26. Likewise, the arm portion 31 is formed with the guide groove 36 for guiding the support shaft 26 to the bearing hole 34 in the process of assembling the lever 30 with the housing 10. The guide groove 36 is formed with the retracted portion 39. In the process of assembling the lever 30 with the housing 10, the support shafts 26 move in the retracted portions 39 with the arm portions 31 held in contact with the front posture suppressing portions 25F, whereby the operating portion 32 can be displaced away from the wire bundle 27.

As just described, according to the lever-type connector F of this embodiment, even if the arm portions 31 come into contact with the posture suppressing portions to suppress a posture change of the lever 30 in the process of assembling the lever 30 with the housing 10, the support shafts 26 move in the retracted portions 39, whereby the operating portion 32 is displaced away from the wire bundle 27. In this way, a reduction in workability due to the interference of the operating portion 32 with the wire bundle 27 can be prevented. Further, since the inner side surface of the retracted portion 39 is formed only by the curved surface, the support shaft 26 is not caught when sliding in contact with the inner side surface of the retracted portion 39 and workability in assembling the lever 30 is good.

Further, the guiding opening 37 of the guide groove 36 is formed to be open in the outer peripheral edge of the arm portion 31 and the guide groove 36 includes the shortest guiding portion 38 linearly connecting the guiding opening 37 and the bearing hole 34. If the operating portion 32 possibly does not interfere with the wire bundle 27, the support shafts 26 can be linearly moved in the shortest guiding portions 38, wherefore workability is good.

Further, the guide groove 36 includes the wide portion 40 having a width larger than the inner diameter of the bearing hole 34 and the opening width of the guiding opening 37 and a part of the wide portion 40 serves as the retracted portion 39. According to this configuration, a positional relationship of the housing 10 and the lever 30 is specified in fitting the guide grooves 36 and the support shafts 26 because the guiding openings 37 of the guide grooves 36 are relatively narrow. Thus, it can be avoided that the lever 30 is assembled in an improper orientation or posture with respect to the housing 10. Further, when the arm portions 31 come into contact with the front posture suppressing portions 25F and the support shafts 26 move in the wide portions 40, a degree of freedom is high in changing the posture and position of the lever 30 since movement allowable ranges of the support shafts 26 are wide in the width directions of the guide grooves 36.

Further, the lever 30 is rotatable between the initial position where the lever 30 waits at the start of connection to the mating connector M and the connection position where the connection to the mating connector M is completed. The reverse rotation restricting projection 45 projecting from the area corresponding to the guide groove 36 is formed on the surface (inner surface) of the arm portion 31 on the side opposite to the guide groove 36. The housing 10 is formed with the rotation restricting portions 20 for restricting the rotation of the lever 30 at the initial position toward the side opposite to the connection position by being locked to the reverse rotation restricting projections 45. Since the formation area of the guide groove 36 in the arm portion 31 is thin and easily resiliently deformed, resistance when the reverse rotation restricting projections 45 move over the rotation restricting portions 20 in the process of assembling the lever 30 with the housing 10 is suppressed to be low.

Further, the reverse rotation restricting projection 45 projects toward the housing 10 (terminal accommodating portion 11) from the surface of the arm portion 31 facing the housing 10 (terminal accommodating portion 11 or side wall portion 16). Thus, the outer diameter of the arm portion 31 can be made smaller as compared to the case where a reverse rotation restricting projection is formed to project radially outward from the outer peripheral edge of the arm portion 31.

Further, the guide groove 36 is formed with the pair of slits 43 disposed to sandwich the formation area of the reverse rotation restricting projection 45. Since the area of the guide groove 36 where the reverse rotation restricting projection 45 is formed serves as the deformation facilitating portion 44 made easily resiliently deformable by the pair of slits 43, resistance when the reverse rotation restricting projection 45 moves over the rotation restricting portion 20 is suppressed to be even lower.

Further, the guide groove 36 includes the guiding opening 37 open in the outer peripheral edge of the arm portion 31 and the guiding inclined portion 41 inclined to make the guide groove 36 deeper from the hole edge part of the bearing hole 34 toward the guiding opening 37. The reverse rotation restricting projection 45 is disposed in the area (deep groove portion 42) closer to the guiding opening 37 than the guiding inclined portion 41. Since the area of the guide groove 36 closer to the guiding opening 37 than the guiding inclined portion 41 is thin and easily resiliently deformed, resistance when the reverse rotation restricting projection 45 moves over the rotation restricting portion 20 is small.

Further, the housing 10 is formed with the separation restricting portions 18. In the process of assembling the lever 30 with the housing 10, the reverse rotation restricting projections 45 are locked to the separation restricting portions 18, thereby restricting the separation of the lever 30 from the housing 10. Since the reverse rotation restricting projections 45 have both a function of restricting reverse rotation of the lever 30 and a function of restricting the separation of the lever 30 from the housing 10 as just described, the shape of the lever 30 can be simplified.

Further, the lever 30 is rotatable between the initial position where the lever 30 waits at the start of connection to the mating connector M and the connection position where the connection to the mating connector M is completed, and the initial position holding projections 46 for restricting the rotation of the lever 30 at the initial position toward the connection position are formed at positions near the guide grooves 36 in the arm portions 31. Since these initial position holding projections 46 are disposed at the positions not corresponding to the guide grooves 36, the initial position holding projections 46 can be formed to be thick. Thus, a function of holding the lever 30 at the initial position is high.

The invention is not limited to the above described and illustrated embodiment. For example, the following embodiments also are included in the scope of the invention.

Although the lever includes the two arms in the above embodiment, the lever may include only one plate-like arm and the operating portion may extend parallel to the axis of the support shaft from the outer peripheral edge of the arm.

Although the reverse rotation restricting projection is disposed in the area corresponding to the guide groove in the above embodiment, the reverse rotation restricting projection may be disposed in a different area.

The lever is formed with the guide grooves for guiding the support shafts to the bearing holes in the above embodiment. However, the lever may have no guide groove.

The guide groove has two slits sandwiching the reverse rotation restricting projection in the above embodiment. However, slits may not be provided.

The reverse rotation restricting projection restricts reverse rotation of the lever and restricts separation of the lever from the housing in the above embodiment, but the reverse rotation restricting projection may function only to restrict reverse rotation of the lever.

Although the reverse rotation restricting projection is formed on the inner surface of the arm in the above embodiment, the reverse rotation restricting projection may be formed on the outer surface of the arm.

LIST OF REFERENCE SIGNS

F . . . lever-type connector
M . . . mating connector
10 . . . housing
18 . . . separation restricting portion
20F . . . front rotation restricting portion (rotation restricting portion)
20R . . . rear rotation restricting portion (rotation restricting portion)
26 . . . support shaft
30 . . . lever
31 . . . arm
34 . . . bearing hole
36 . . . guide groove
37 . . . guiding opening
41 . . . guiding inclined portion
43 . . . slit
45 . . . reverse rotation restricting projection

What is claimed is:

1. A lever-type connector (F), comprising:

a housing (10) formed with a support shaft (26) and a rotation restricting portion (20F, 20R);

a lever including a plate-like arm, a bearing hole formed in the arm and being fit to the support shaft of the housing so that the lever is rotatable between an initial position where the lever waits at a start of connection to a mating connector and a connection position where the connection to the mating connector is completed, the arm being formed with a guide grove configured to guide the support shaft to the bearing hole when assembling the lever with the housing; and a reverse rotation restricting projection projecting from a surface of the arm facing the housing toward the housing, the reverse rotation restricting projection being disposed in an area corresponding to the guide groove on a surface of the arm on a side opposite to the guide groove and being configured to restrict rotation of the lever at the initial position toward a side opposite to the connection position by being locked to the rotation restricting portion.

2. The lever-type connector of claim 1, wherein the guide groove is formed with two slits disposed to sandwich a formation area of the reverse rotation restricting projection.

3. The lever-type connector of claim 1, wherein:

the guide groove includes a guiding opening formed to be open in an outer peripheral edge of the arm and a guiding inclined portion inclined to make the guide groove deeper from an edge of the bearing hole toward the guiding opening; and the reverse rotation restricting projection is disposed in an area on a side closer to the guiding opening than the guiding inclined portion.

4. A lever-type connector, comprising:

a housing formed with a support shaft, a rotation restricting portion and a separation restricting portion;

a lever including a plate-like arm, a bearing hole formed in the arm and being fit to the support shaft of the housing so that the lever is rotatable between an initial position where the lever waits at the start of connection to a mating connector and a connection position where the connection to the mating connector is completed; and a reverse rotation restricting projection projecting toward the housing from a surface of the arm facing the housing, the reverse rotation restricting projection being configured to be locked to the rotation restricting portion to restrict rotation of the lever at the initial position toward a side opposite to the connection position, the separation restricting portion being configured to restrict separation of the lever from the housing by being locked to the reverse rotation restricting projection when assembling the lever with the housing.

5. The lever-type connector of claim 4, wherein:

the arm is formed with a guide groove configured to guide the support shaft to the bearing hole when assembling the lever with the housing; and the reverse rotation restricting projection is disposed in an area corresponding to the guide groove on a side opposite to the guide groove.

* * * * *